US008127407B2

(12) United States Patent
Wong et al.

(10) Patent No.: US 8,127,407 B2
(45) Date of Patent: Mar. 6, 2012

(54) PACKAGED ITEM INCLUDING A PACKAGING TIE-DOWN

(75) Inventors: Chiu Wah Wong, Quarry Bay (HK); Lu Jian Xu, ZhuZhou (CN); Charles H DeVoe, Portland, OR (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/113,916

(22) Filed: May 23, 2011

(65) Prior Publication Data

US 2011/0220528 A1 Sep. 15, 2011

Related U.S. Application Data

(63) Continuation of application No. 11/484,525, filed on Jul. 10, 2006, now Pat. No. 7,958,604.

(60) Provisional application No. 60/741,196, filed on Nov. 30, 2005, provisional application No. 60/741,786, filed on Dec. 1, 2005, provisional application No. 60/742,807, filed on Dec. 5, 2005, provisional application No. 60/758,115, filed on Jan. 10, 2006.

(51) Int. Cl.
*B65D 73/00* (2006.01)

(52) U.S. Cl. ..... 24/198; 206/478

(58) Field of Classification Search ..... 24/198, 24/200, 713.1; 206/478, 495
See application file for complete search history.

(56) References Cited

U.S. PATENT DOCUMENTS

| | | | | |
|---|---|---|---|---|
| 2,269,696 | A * | 1/1942 | Shaulson | 24/200 |
| 2,270,702 | A * | 1/1942 | Getmansky | 24/459 |
| 3,324,997 | A * | 6/1967 | Bonanno | 206/765 |
| 3,811,565 | A * | 5/1974 | Tancredi | 206/478 |
| 4,457,051 | A * | 7/1984 | Bartolini | 24/198 |
| 4,637,099 | A * | 1/1987 | Kasai | 24/200 |
| 5,432,985 | A * | 7/1995 | Bernart | 24/265 AL |
| 7,958,604 | B2 * | 6/2011 | Wong et al. | 24/198 |

* cited by examiner

*Primary Examiner* — James Brittain
(74) *Attorney, Agent, or Firm* — Kolisch Hartwell, PC

(57) ABSTRACT

A packaged item including one or more packaging tie-downs configured to retain objects secured with a retention strap in association with packaging material.

20 Claims, 8 Drawing Sheets

PACKAGED ITEM INCLUDING A PACKAGING TIE-DOWN

This application is a continuation of U.S. patent application Ser. No. 11/484,525, filed Jul. 10, 2006 and entitled "PACKAGING TIE-DOWNS", which claims the benefit of the priority under 35 U.S.C. §119 of prior Provisional Patent Application Ser. No. 60/741,196, titled PACKAGING TIE-DOWNS, filed Nov. 30, 2005; prior Provisional Patent Application Ser. No. 60/741,786, titled PACKAGING TIE-DOWNS, filed Dec. 1, 2005; prior Provisional Patent Application Ser. No. 60/742,807, titled PACKAGING TIE-DOWNS, filed Dec. 5, 2005; and prior Provisional Patent Application Ser. No. 60/758,115, titled PACKAGING TIE-DOWNS, filed Jan. 10, 2006; each of which are being incorporated herein by reference in their entirety for all purposes.

BACKGROUND

A variety of devices and techniques have been employed to secure packaged items. For example, packaged items may be secured by molded foam or inflated cushions, but are often secured to a backing sheet with one or more securing devices. Previous examples of such securing devices include the reinforcing band strip of U.S. Pat. No. 3,811,565 to Tancredi (1974), and the secure packaging system of U.S. Pat. No. 6,575,302 to Robley, Jr. (2003), both of which are incorporated by reference. Holding members for securing items to walls and other hard surfaces have been described in European patent application no. 0115692 by Delahunty (1987), also incorporated by reference.

Previous securing devices have often included coated flexible wires, or 'twist-ties'. For example, in the case of packaged toy 10 of FIG. 1, a toy FIG. 12 is secured to a backing sheet 14 in a display box 16. FIG. 12 is secured to backing sheet 14 with multiple twist-ties 18. The ends of the twist-ties protrude from the rear surface of backing sheet 14, as shown in FIG. 2. In order to remove the toy figure from the packaging, the backing sheet must be removed from display box 16, but then each of the twist-ties must be untwisted, and pulled through the backing in order to free the figure. This process can be both frustrating and time-consuming, particularly for small children. Additionally, the twist-ties require time and attention to apply during packaging.

The packaged items including at least one tie-down of the present disclosure may be inexpensively produced, may be quickly and easily applied during packaging, and can be removed easily, even by children.

DESCRIPTION OF PREFERRED EMBODIMENTS

Figure 1:
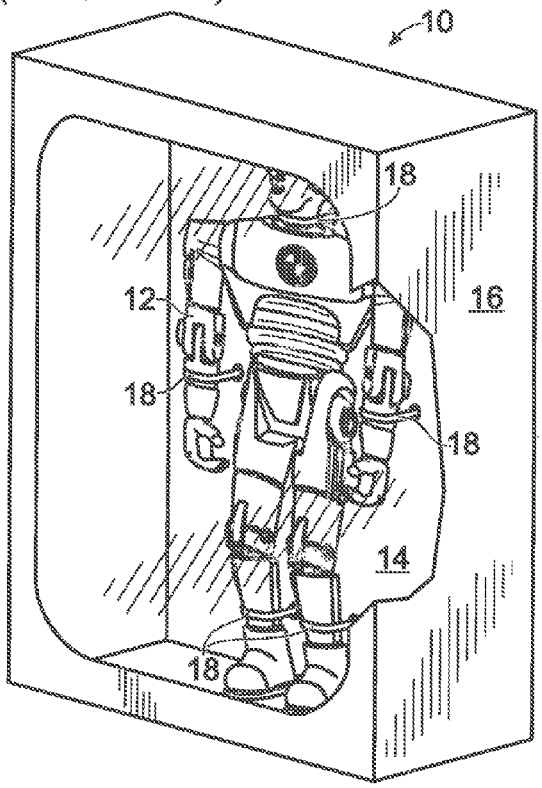
Fig. 1 (PRIOR ART)
FIG. 1 is an isometric cutaway view of a packaged toy figure according to the prior art.
Figure 2:
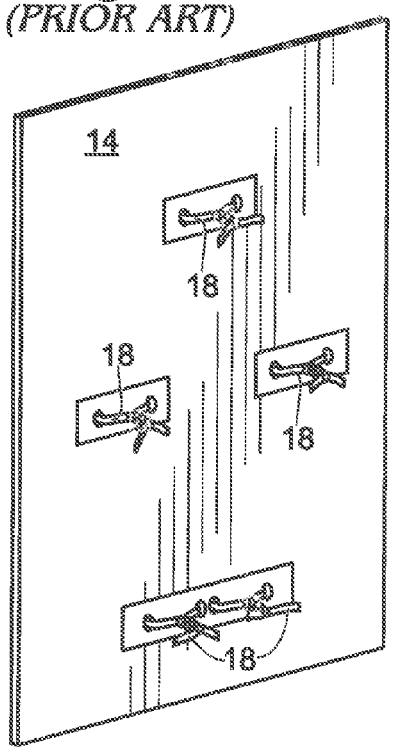
Fig. 2 (PRIOR ART)
FIG. 2 is an isometric view of the rear of the backing sheet of the packaged toy figure of FIG. 1.

The present invention provides embodiments of a packaged item including one or more packaging tie-downs configured to secure objects to packaging materials in combination with a retention strap. An exemplary packaging tie-down 20 is shown in FIGS. 3-12. Tie-down 20 includes a substantially planar base 22, and an engaging structure 24 that is configured to securely engage a retention strap. Exemplary engaging structure 24 includes an open slot 26 defined by a tongue 28.

Figure 3:
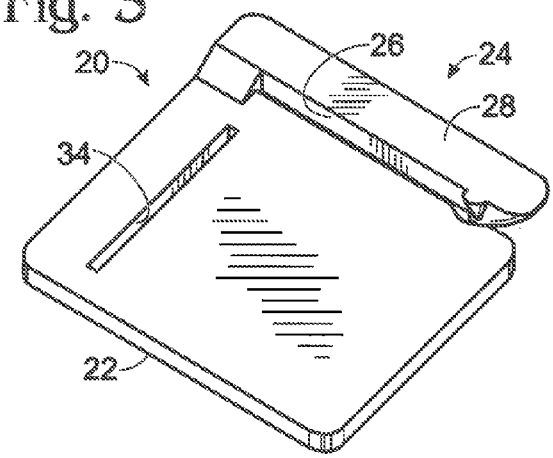
FIG. 3 depicts a front perspective view of an exemplary packaging tie-down.

The exemplary tie-down 20 also includes an aperture in base 22. As shown in FIG. 3, the aperture may be a slit 34.

Typically, slit 34 and open slot 26 are disposed at an angle to each other; preferably they are disposed at approximately 90 degrees from each other.

The packaging tie-downs of the present disclosure are typically configured to be used in conjunction with one or more pieces of packaging material, in order to secure a packaged item. As used herein, "packaging material" is meant to include any material to which an item is to be secured using a tie-down of the present disclosure. Although not required, the packaging material generally includes a surface or portion of a surface that is substantially planar. The packaging material can be used in packaging an item for storage, shipping, or display. The packaging material can be the surface of a box, a backing sheet, an internal partition, or another sufficiently sturdy piece of material.

Figure 4:
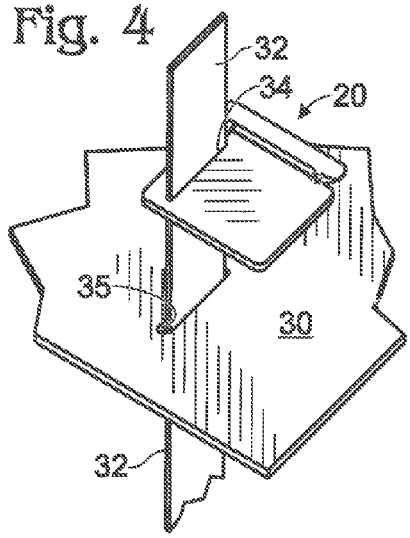
FIG. 4 depicts a front perspective view of the exemplary packaging tie-down of FIG. 3 in combination with a backing, with a retention strap inserted through the backing and the tie-down.

The exemplary tie-down 20 is shown in combination with a portion of planar packaging material 30 in FIG. 4, wherein a retention strap 32 is first passed through an opening 35 in packaging material 30, then threaded through slit 34, as shown.

Figure 5:
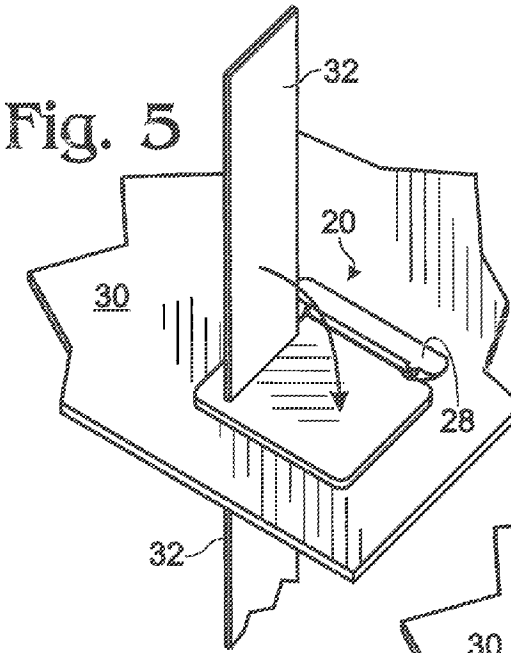
FIG. 5 depicts a front perspective view of the exemplary packaging tie-down of FIG. 1 flush with the backing, and with a retention strap inserted through the backing and the tie-down.
Figure 6:
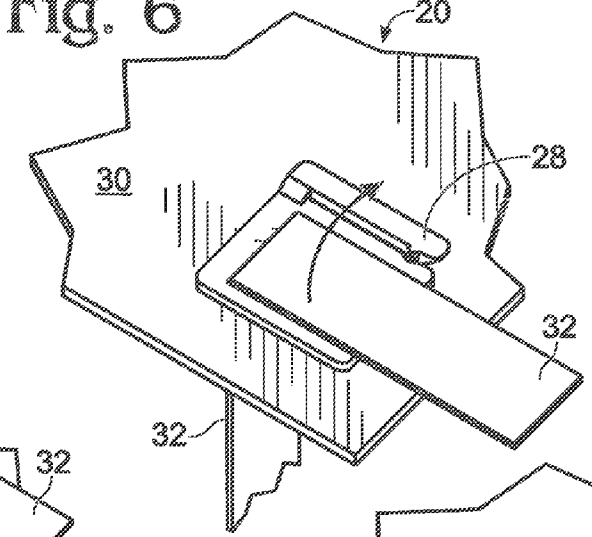
FIG. 6 depicts a front perspective view of the exemplary packaging tie-down of FIG. 5, with the retention strap pressed against the tie-down.
Figure 7:
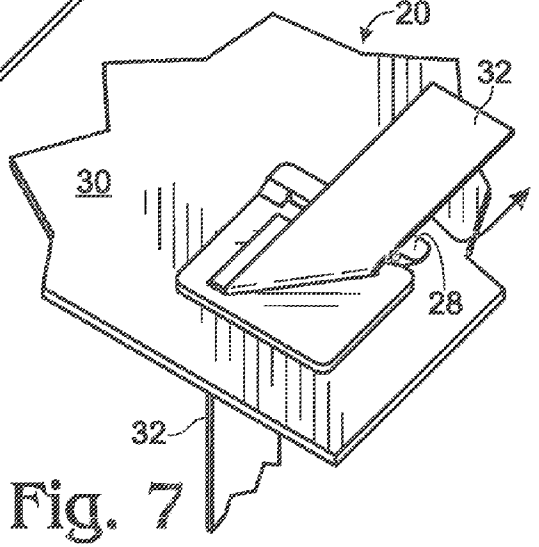
FIG. 7 depicts a front perspective view of the exemplary packaging tie-down of FIG. 6, with the retention strap folded at a right angle.
Figure 8:
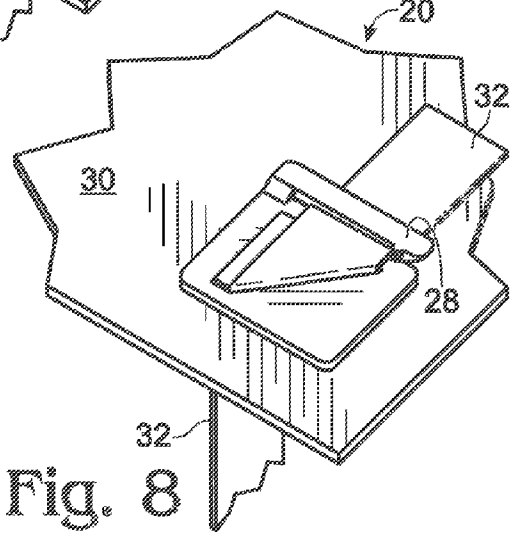
FIG. 8 depicts a front perspective view of the exemplary packaging tie-down of FIG. 7, with the retention strap folded and inserted into the engaging structure of the tie-down.

Once retention strap 32 is threaded through both the packaging material and through slit 34 of the tie-down, the tie-down may be placed against the packaging material, as shown in FIG. 5. As shown by the arrow in FIG. 5, the retention strap may then be pressed flat against the base of the tie-down. That is, the retention strap 32 is folded down as shown in FIG. 6. In order to further secure the tie-down, the retention strap may then be folded toward tongue 28, as indicated by the arrow in FIG. 6, to create an approximate right-angle fold in the retention strap, as shown in FIG. 7. The tie-down may then be firmly secured by threading and/or slipping retention strap 32 under tongue 28 and into open slot 26, as indicated by the arrow in FIG. 7. The resulting arrangement of retention strap and tie-down is shown in FIG. 8.

By folding the retention strap and inserting it into the engaging structure 24, the retention strap may be securely engaged by the tie-down. The retention strap is optionally tensioned before it is engage by the engaging structure. Tensioning the retention strap includes eliminating slack in the retention strap, and drawing the strap taut to enhance the interaction of the retention strap with the tie-down. The retention strap may be tensioned either by pulling on the free end of the retention strap, by urging the tie-down against the packaging material, or by a combination thereof. The retention strap may be tensioned before it is folded and/or engaged by the engaging structure. Once retention strap 32 is engaged and tensioned, excess retention strap 32 can be removed by trimming, although a sufficient length of retention strap extending from the tie-down may be preserved to facilitate removal of the tie-down. Although the retention strap is shown in FIGS. 7 and 8 as having been folded over itself at an approximate right angle, the retention strap may also be folded under itself without compromising the utility and security of the packaging tie-down. Depictions of folded retention straps throughout the specification should be understood to include straps that are both folded over and folded under when securing a tie-down.

Figure 9:
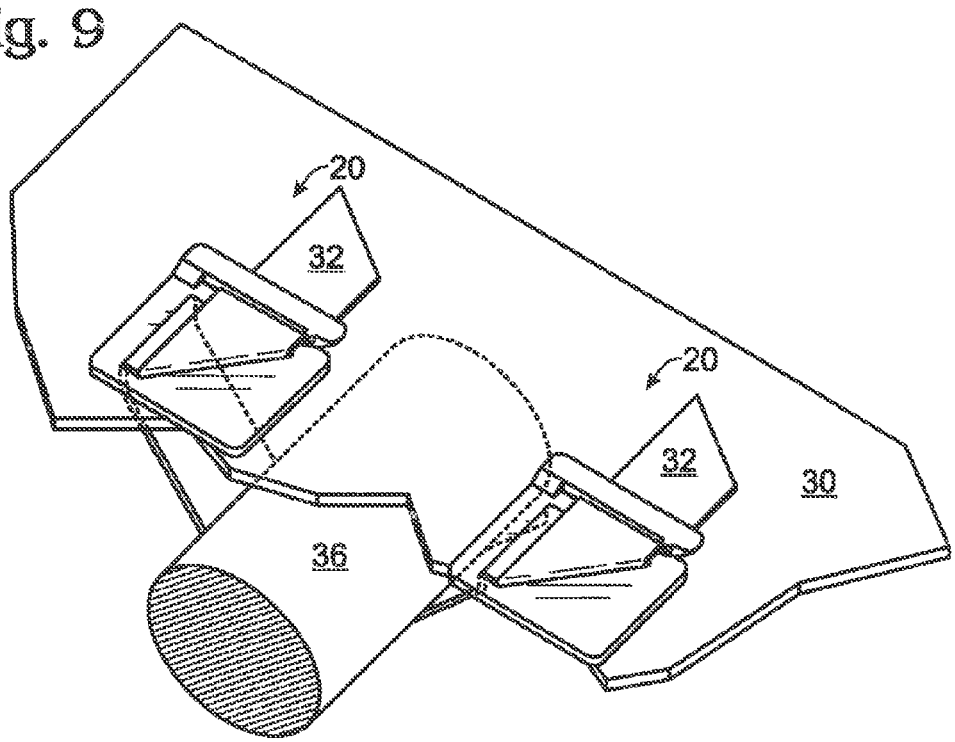
FIG. 9 depicts a front perspective view of two exemplary packaging tie-downs, as shown in FIG. 3, securing an item against a backing in combination with a retention strap.

The disclosed tie-down may be used to securely fasten one end of a retention strap that is passed through a piece of packaging material. By securing a retention strap in this manner, a variety of items may be secured within and/or against selected packaging materials. For example, the disclosed tie-down may be used in pairs, one tie-down securing each end of a single selected retention strap, as shown in FIG. 9. By using a pair of tie-downs in this manner, an item 36 may be secured to the packaging material 30. The configuration of the tie-down permits the retention strap to be tensioned as it is secured, as discussed above. By tensioning retention strap 32, item 36 is held more firmly against packaging material 30.

Item 36 is representative of any of a variety of items or objects that may be secured using the disclosed tie-downs. Modern packaging often includes blister packs or transparent windows, where it is preferred that the packaged item be retained in an appropriate position and/or orientation for display. Alternatively, or in addition, proper packaging may help prevent damage to the item during shipping. The disclosed tie-downs are useful for securing a variety of objects and items, and either the tie-down, the retention strap, or both, may be scaled up or down in size as appropriate for the item or object to be secured. In particular, the disclosed tie-down is of particular utility when used in conjunction with any of a variety of packaged toys, including for example action figures, figurines, dolls, vehicles, and other toys.

Figure 10:
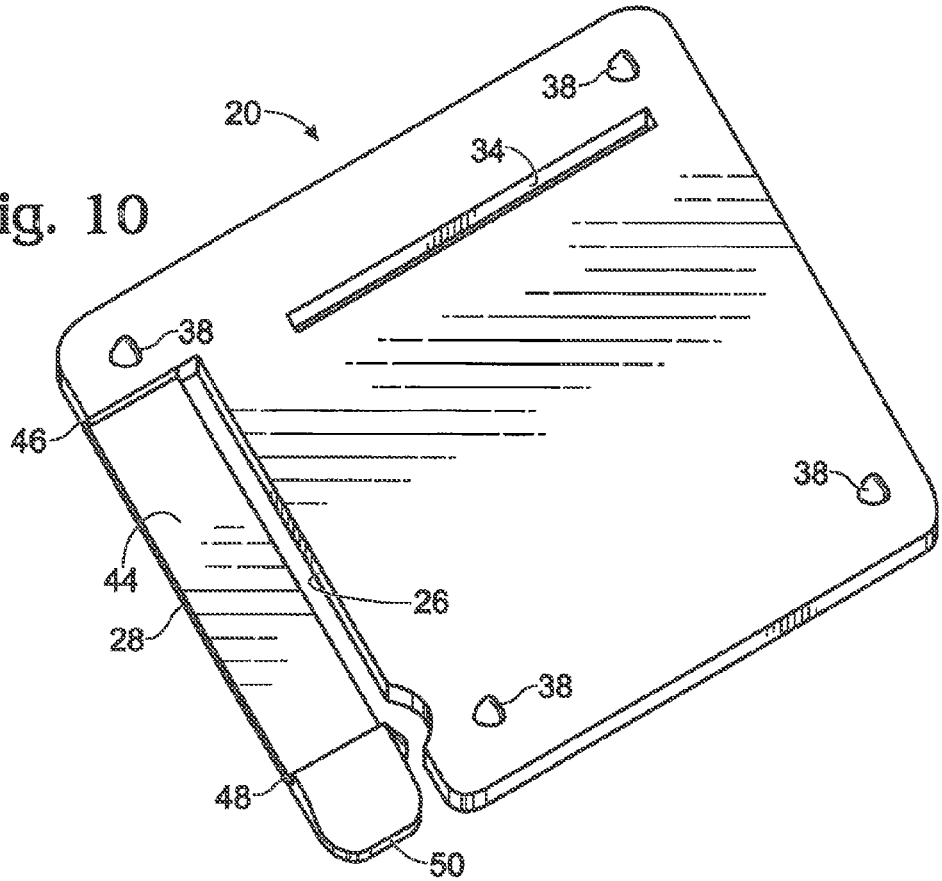
FIG. 10 depicts a view of the underside of the exemplary packaging tie-down of FIG. 3.

During use, the underside of the tie-down is typically pressed firmly against the selected packaging material. The underside of exemplary tie-down 20 is shown in FIG. 10. Although the tie-down may be held in place sufficiently well by tension applied to the retention strap, additional methods of enhancing retention of the tie-down in place can also be employed. The tie-down can be affixed to the packaging material using an adhesive, by thermal or chemical welding, or by mechanical attachment, among other methods. For example, the tie-down may be secured to the packaging material by an adhesive on the underside of the tie-down. Alternatively, or in addition, the entire tie-down may be taped in place, for example, after the retention strap has been tightened. In one aspect of the disclosed tie-down, the underside of the tie-down includes one or more protrusions 38 which may be configured to enhance the attachment of the tie-down to the desired packaging material. Protrusions 38 may have any suitable shape in order to positively interact with the packaging material. For example, the protrusions may be pin- or peg-shaped, hemispherical, conical, or frustoconical, so that the protrusions can be embedded partially into a suitably yielding packaging material, such as cardboard. As shown in FIG. 10, protrusions 38 can be conical, and there may be a plurality of protrusions on the underside of the tie-down, for example at least four protrusions, as shown in FIG. 10. Tensioning the retention strap, as discussed above, may establish or enhance an attachment of the tie-down against a piece of packaging material, by urging the protrusions into engagement with the surface of the packaging material.

Slit 34, through which retention strap 32 is threaded, typically is a narrow slit through base 22 of tie-down 20. Slit 34 is generally configured so that the retention strap may be readily inserted and threaded through the slit. Slit 34 may be rectangular in shape, with square ends, or the ends of the slit may be more or less rounded. The side walls that define the slit may be straight and parallel, or the slit opening may be chamfered (beveled) on one or both sides to improve the ease of threading a retention strap through the slit, or to achieve a desired retention strength on a threaded retention strap. Depictions of slits in the tie-downs of the specification should be understood to include apertures of other shapes and sizes, that may include features for facilitating threading, enhancing retention, or both.

Additionally, or in the alternative, one end of the slit of the tie-down can be extended to the edge of the tie-down, thereby forming an open slot. Such a configuration may include one or more structures to help retain a retention strap, as discussed below with respect to engaging structures. An open configuration may improve the ease of threading a retention strap through the slit.

As discussed above, the interaction between the retention strap and the engaging structure secures the retention strap to the tie-down. The engaging structure can include one or more features to assist in engaging and retaining the retention strap. Typically, the engaging structure is selected so that the retention strap can be easily engaged by the engaging structure. Also preferably, the engaging structure is selected so that the retention strap can be readily disengaged from the tie-down. Typically, the engaging structure includes an open slot, such as slot 26.

Figure 11:
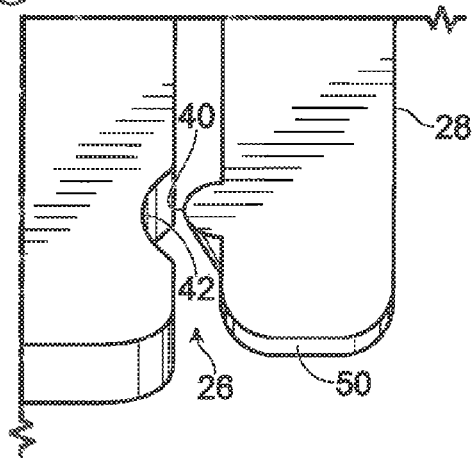
FIG. 11 depicts a partial view of the engaging structure of the exemplary tie-down of FIG. 3.

As shown in FIG. 11, tongue 28 of engaging structure 24 may optionally include a tab 40 projecting into open slot 26 configured to help secure the retention strap beneath tongue 28. The opposing side of open slot 26 from tab 40 may further feature a corresponding indentation 42 to cooperate with tab 40. As shown, tab 40 may be generally semi-conical. Alternatively, tab 40 may be semi-cylindrical, hemispherical, or any other shape that assists in securing retention strap 32 in open slot 26.

The interaction between retention strap 22 and tongue 28 can be further enhanced by the presence of a groove 44 on the underside of tongue 28, defined by groove edges 46 and 48, as shown in FIG. 10. Groove 44 is configured to provide a channel to accommodate retention strap 32 when it is passed under tongue 28, and may provide additional security to help retain retention strap 32 from slipping out of open slot 26, particularly when the underside of the tie-down is pressed firmly against packaging material. In addition, facile insertion of retention strap 32 into open slot 26 may be enhanced by beveling, rounding, or otherwise contouring the end 50 of tongue 28 adjacent to the entrance of open slot 26. Tongue 28 may also be elevated with respect to the surface of tie-down base 22, to further facilitate the insertion and removal of retention strap 32 from open slot 26.

Figure 12:
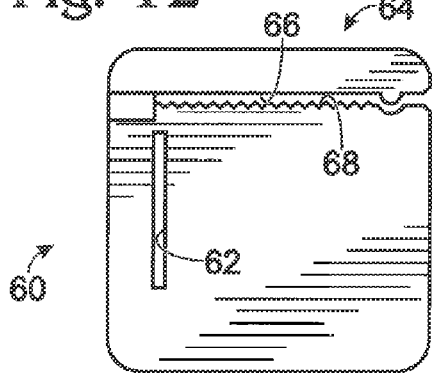
FIG. 12 is a plan view of an alternative exemplary packaging tie-down of the present disclosure.
Figure 13:
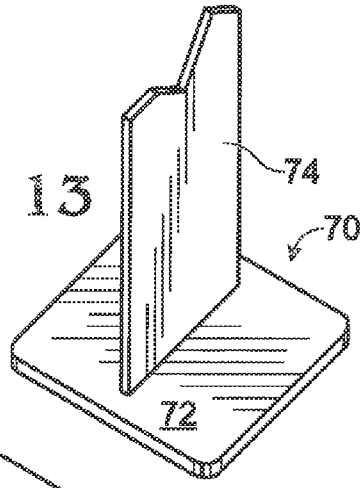
FIG. 13 is a perspective view of an exemplary retention plate of the present disclosure.

Alternatively, or in addition, the configuration of the open slot of the engaging structure may be modified to improve the security of the retention strap. For example, as shown in FIG. 12, an alternative exemplary tie-down 60 includes a slit 62 and an engaging structure 64, where the engaging structure includes an open slot 66. Open slot 66 incorporates a serrated edge 68 configured to improve the frictional retention and/or immobilization of an inserted retention strap. In other embodiments, a variety of textures can be employed on this edge, the other inside edges of the open slot of the engaging structure, and/or any other surface making contact with a retention strap, potentially useful textures including without limitation serrations, crenellations, hatching, cross-hatching, and other regular and irregular patterning.

Typically, the disclosed packaging tie-down is readily removable. By grasping the free end of retention strap 32 and slipping it out of open slot 26, and concomitantly out from under tongue 28, the tie-down is freed, and can then be slipped off of retention strap 32 and removed. Unpacking a secured item can therefore be performed quickly and easily, and requires no special tools. However where secure fastening of an item is desired but ease of removal is not a priority, for example where an item is intended to be permanently mounted or displayed, the engaging structure can be configured to resist removal of the retention strap. For example, the entrance of the open slot of the engaging structure can optionally incorporate a 'one-way' mechanism, for example by incorporated a detent, an elastic latch, or inwardly projecting barbs, among other mechanisms.

Retention strap 32 can be configured to have a variety of widths and thicknesses, provided that the strap remains substantially flexible, and the tie-down is configured to receive and retain the selected retention strap. Typically, the retention strap is manufactured from a flexible plastic, which may be opaque or transparent.

Figure 14:
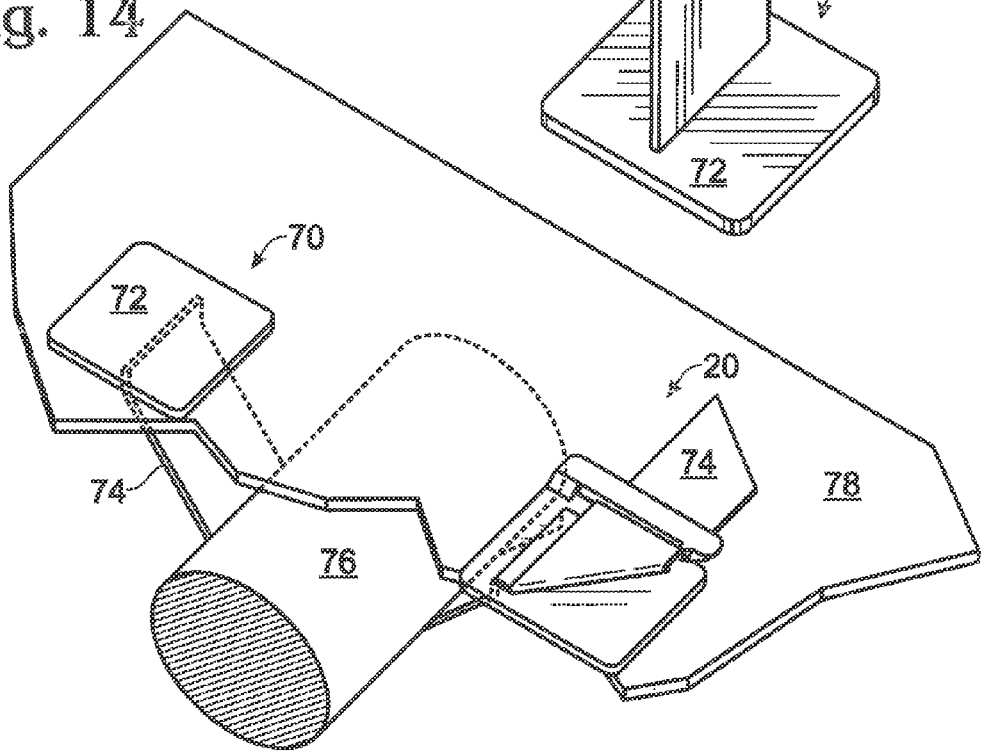
FIG. 14 depicts a perspective view of an item secured against a packaging material by an exemplary retention plate in combination with an exemplary packaging tie-down, according to the present disclosure.

As an alternative to securing each end of a retention strap with a packaging tie-down, the tie-downs of the present disclosure may be used in combination with a retaining plate 70, which incorporates both a substantially planar base 72 and a retention strap 74 that is attached to base 72 as shown in FIG. 14. The retention strap may be attached to the planar base by any suitable attachment method, including adhesives, heat-staking, chemical welding, mechanical attachment, or co-molding. The retaining plate may be used to secure one end of a retention strap, where the retention strap is used to secure an item against selected packaging material.

For example, as shown in FIG. 14, retaining plate 70 can be used to secure retention strap 74, which in turn secures item 76 against packaging material 78. The end of retention strap 74 can be secured by, for example, tie-down 20, as described above. The use of retaining plate 70, in place of a second tie-down, may eliminate the need of threading one end of the retention strap through one of the tie-downs. The packaging operation can therefore be made faster, more efficient, and more economical.

Figure 15:
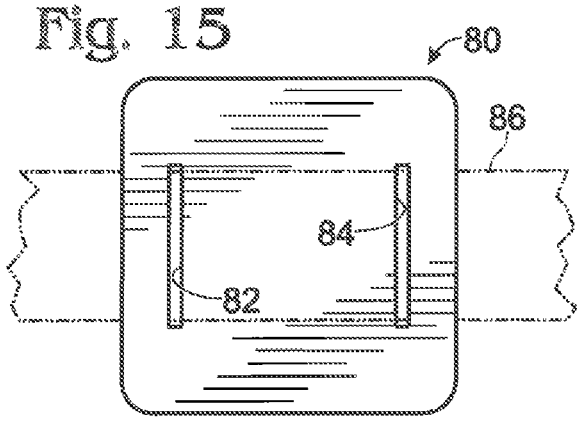
FIG. 15 is a plan view of an alternative exemplary packaging tie-down of the present disclosure.

As an alternative, or in addition, to using a packaging tie-down of the disclosure, a tie-down having two slits and no engaging structure may be utilized to secure a retention strap. For example, as shown in FIG. 15, alternative tie-down 80 includes two substantially parallel slits 82 and 84 and no engaging structure. By threading retention strap 86 (shown in dashed lines) through slits 82 and 84, tie-down 80 may be useful in securing a retention strap threaded through the tie down, possibly through slits in an underlying packaging material. For example, tie-down 80 may be useful to secure an intermediate point on retention strap 86, so that each end of the strap may be used to secure one or more distinct items when used in combination with one or more additional tie-downs or retaining plates, as previously described.

Although the above discussion referred to an exemplary packaging tie-down that is roughly square in outline, and including a single slit, single open slot, and single tongue, a variety of alternative and exemplary packaging tie-downs that utilize the same operating principle can be envisioned.

The disclosed tie-down need not be approximately square, but could be triangular, rectangular, circular, oval, or any other shape permitting a retention strap to be secured. Alternatively, or in addition, the disclosed tie-down is not limited to a single slit and engaging structure.

Figure 16:
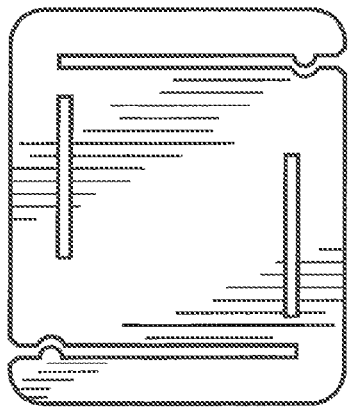
FIG. 16 is a plan view of an alternative exemplary packaging tie-down of the present disclosure.
Figure 17:
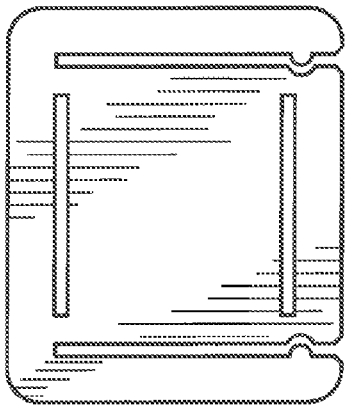
FIG. 17 is a plan view of an alternative exemplary packaging tie-down of the present disclosure.

An exemplary tie-down 87, shown in FIG. 16, includes two slits and two engaging structures, related to each other by a 180 degree rotation, as shown by exemplary tie-down 87 in FIG. 16. Tie-down 87 could be used to provide flexibility in securing a single retention strap in one of two positions, or could be used to secure two retention straps, one on each side of the tie-down. Alternatively, the two sets of slits and engaging structures could be related to each other by a mirror reflection, as demonstrated by tie-down 88, shown in FIG. 17. Tie-down 88 may permit both right- and left-handed operators to fasten the retention strap using a motion and orientation most comfortable for them. Alternatively, tie-down 88 may be used to secure two retention straps.

Figure 18:
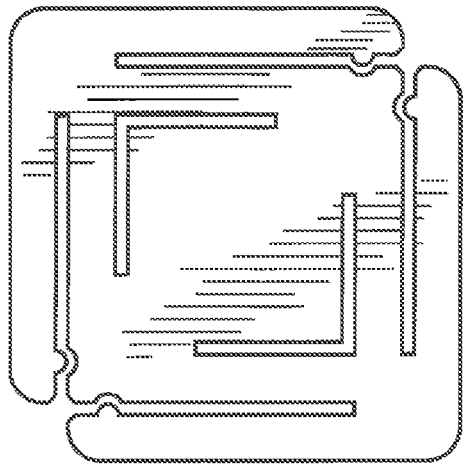
FIG. 18 is a plan view of an alternative exemplary packaging tie-down of the present disclosure.
Figure 19:
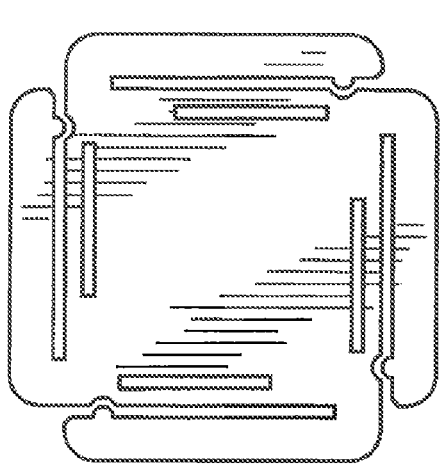
FIG. 19 is a plan view of an alternative exemplary packaging tie-down of the present disclosure.

Alternatively, the disclosed tie-down can include four slits and four engaging structures. For example the tie-down can include slits and engaging structures oriented in opposing pairs, as shown for exemplary tie-down 89 in FIG. 18. Tie-down 18 also includes two slits that form right angle aperture. In addition to offering enhanced flexibility, tie-down 89 may offer both right- and left-handed operation. Alternatively, an exemplary tie-down 90 in FIG. 19 can include four slits and engaging structures oriented in a pin-wheel configuration. Alternatively, the disclosed tie down can include three slits and engaging structure, and may exhibit a trigonal or other geometry. Any geometry and conformation that permits the tie-down to effectively retain one or more retention straps is a suitable geometry and conformation for the purposes of this disclosure.

The packaging tie-down disclosed herein may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like. Typically, the packaging tie-down itself is fabricated from ABS, copolymers of polypropylene-copolymer (PP-co), high-impact polystyrene (HIPS), or phosphorylcholine (PC) polymers. Preferably, the tie-down is fabricated from ABS.

Although the retention strap is typically pliant and resilient, if the material of the retention strap is too soft or metamorphous, performance of the tie-down may be compromised. Typically, the retention strap is fabricated from polypropylene-copolymer (PP-co), polyethylene terephthalate (PET), polyethylene (PE), polyvinylchloride (PVC) or mylar, among others. Preferably the retention strap is fabricated from PVC.

Figure 20:
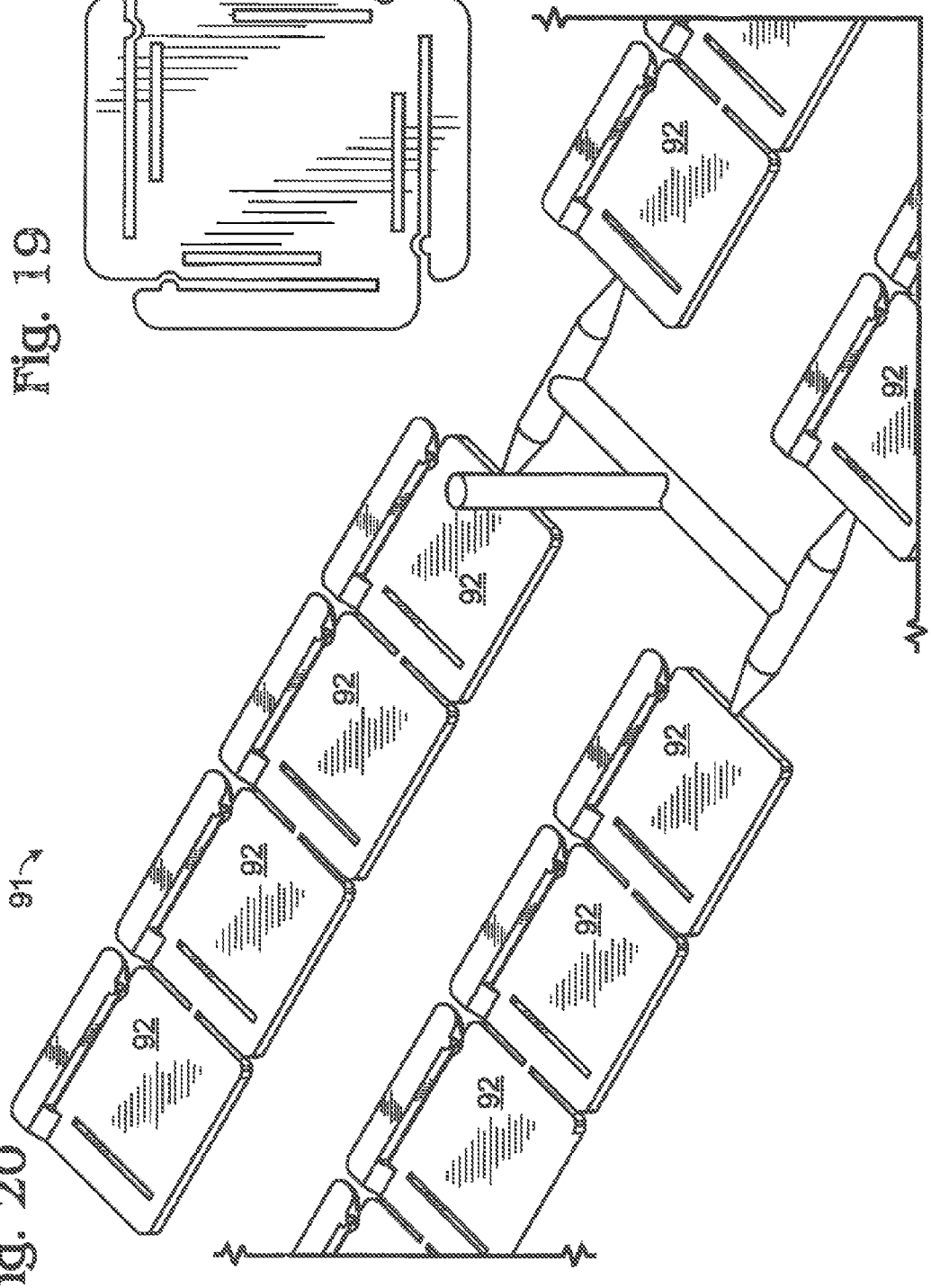
FIG. 20 depicts an array of exemplary packaging tie-downs, produced according to an exemplary manufacturing technique.

Any suitable molding or manufacturing process may be used to prepare the disclosed packaging tie-downs. In particular, the disclosed packaging tie-downs may be manufactured by a molding process, for example injection molding. As shown in FIG. 20, a molded array of tie-downs 91 may include multiple individual tie-downs 92. Multiple tie-downs may be molded into a magazine loadable clip form that is configured to dispense single or multiple tie-downs. Alternatively, the tie-downs may be fabricated in an extended linear chain that is configured to be rolled onto a reel, and dispensed from the reel as needed. Typically, the tie-downs are manufactured in a form that is readily usable by hand, or that is compatible with assembly equipment that aids in packaging operations.

The size of the disclosed packaging tie-downs typically depends on the scale of the item to be secured, and the size of the packaging materials employed. For smaller items, such as toys, the packaging tie-downs may be about 10-20 mm in width, about 10-about 20 mm in length, and about 1-3 mm in thickness, with a retention strap that is about 5-7 mm in width. For securing larger and/or heavier items, the packaging tie-downs may be larger, perhaps on the order of several centimeters, or larger. Typically, the packaging tie-downs disclosed herein are about 14.5 mm wide, about 15 mm long, the tie-down body is about 1.5 mm thick, and the retention strap is about 6 mm wide.

Figure 21:
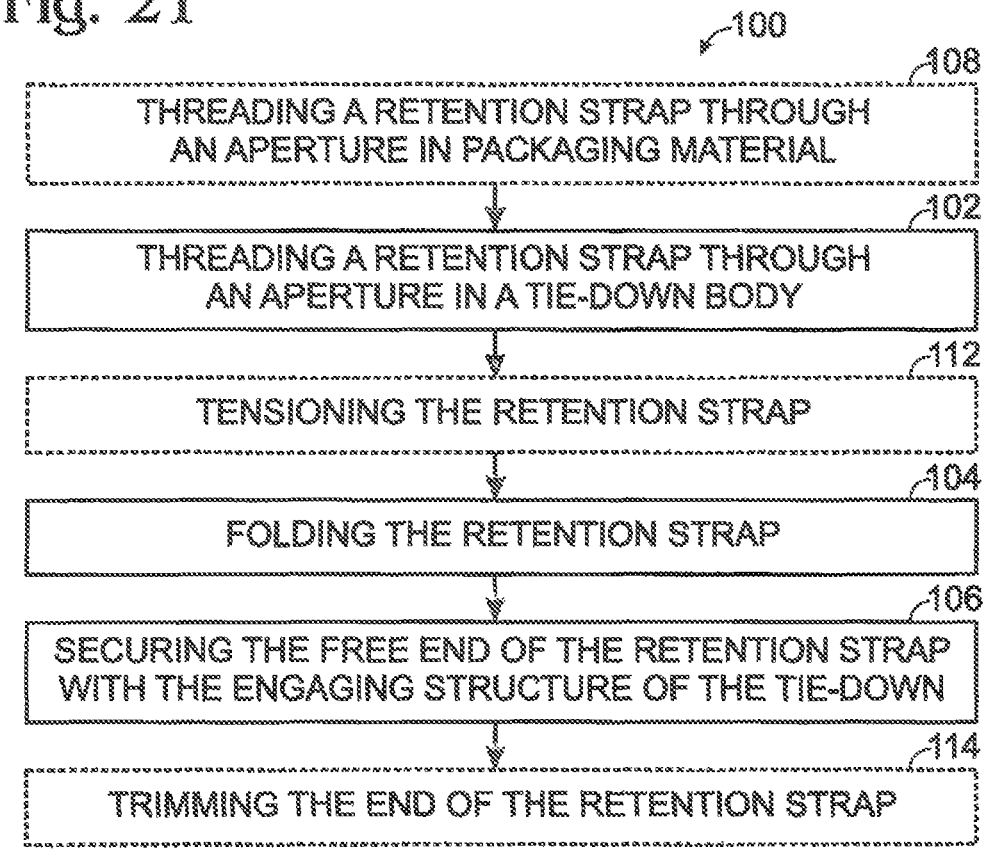
FIG. 21 is a flowchart depicting an exemplary method of securing a retention strap with a packaging tie-down of the present disclosure.

The packaging tie-downs of the disclosure lend themselves to a method 100 of securing a retention strap with a packaging tie-down, as shown in FIG. 21. The method may include threading a retention strap through the aperture in the tie-down body at 102, folding the retention strap at 104, and securing the free end of the retention strap with the engaging structure of the tie-down at 106. Method 100 optionally includes one or more of threading a retention strap through an aperture in the packaging material at 108, tensioning the retention strap at 112, and trimming the free end of the retention strap at 114. Generally, securing the free end of the retention strap with the engaging structure includes inserting the free end of the retention strap under the tongue of the tie-down so that the retention strap passes through the open slot.

The packaging tie-downs described herein may be used in conjunction with automated or semi-automated methods. For example, multiple tie-downs may be manufactured in a clip that is configured to be loaded into, and dispensed by, automated or semi-automated assembly equipment. The assembly equipment could separate an individual tie-down from a clip and thread the first end of a retention strap through the aperture of a first packaging tie-down. An operator could then thread the second end of the retention strap through the slot of a second packaging tie-down. Alternatively, the assembly equipment could thread the second end of the retention strap through the slot of a second packaging tie-down. Typically, an operator would tension the retention strap, and fold and secure the retention strap under the tongue of the tie-down.

The above method of assembly could optionally incorporate the use of a retention plate, in place of the combination of the first tie-down and retention strap. In this aspect, an operator or the assembly equipment could thread the retention strap of a retention plate through the packaging material, thread the second end of the retention strap through the packaging material and through the slot of a packaging tie-down. Securing the free end of the retention strap in the tie-down could then secure an object against the packaging material.

Figure 22:
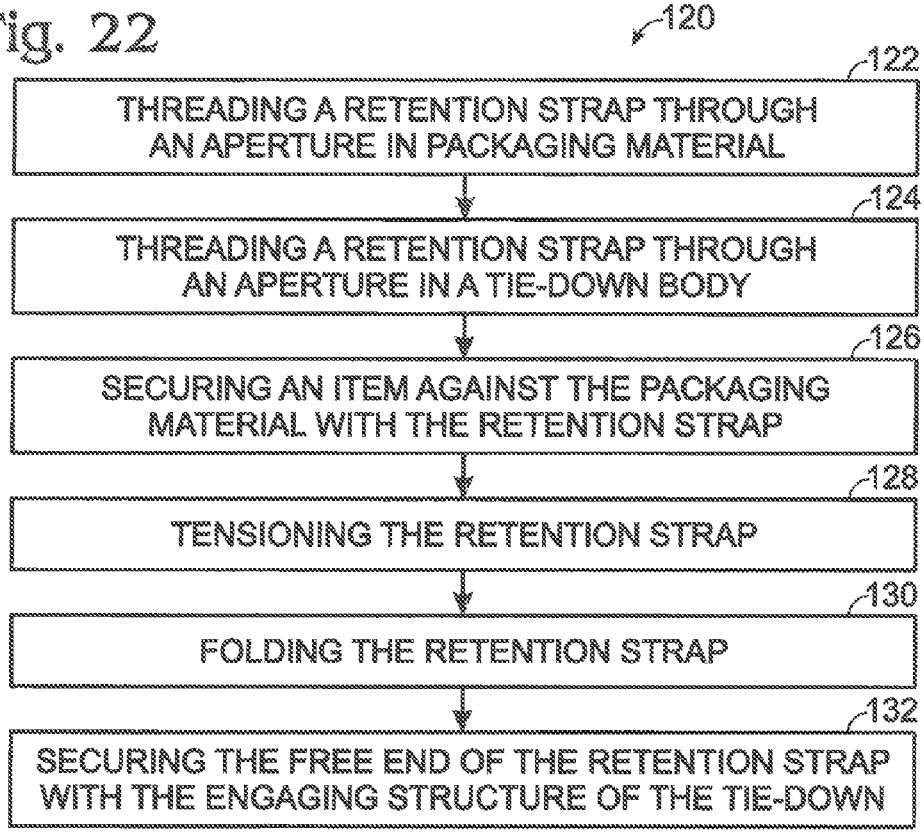
FIG. 22 is a flowchart depicting an exemplary method of securing an item with a packaging tie-down of the present disclosure.

The method of securing a retention strap may be used, in turn, to secure an item to packaging material, as shown by method 120 of FIG. 22. The method may include threading the retention strap through an aperture in a packaging material at 122, threading the retention strap through the aperture in the tie-down body at 124, securing an item against the packaging material with the retention strap at 126, tensioning the retention strap at 128, folding the retention strap at 130, and securing the free end of the retention strap with the engaging structure of the tie-down at 132.

Figure 23:
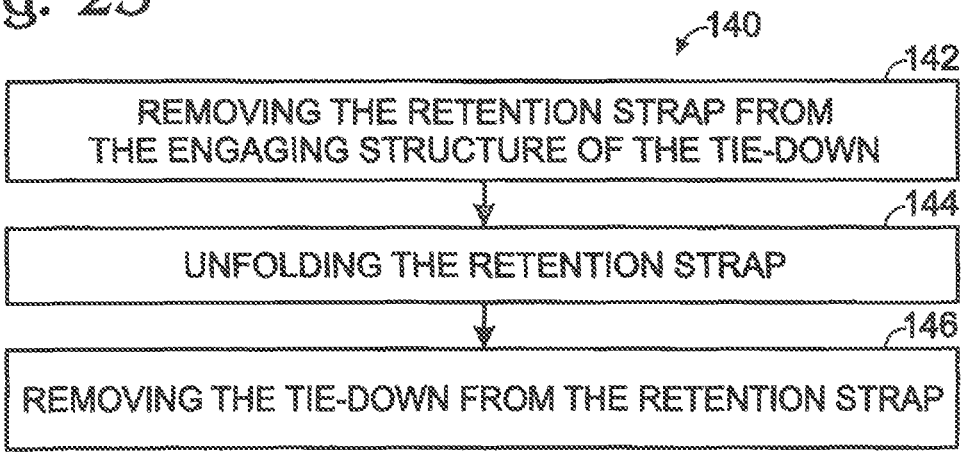
FIG. 23 is a flowchart depicting an exemplary method of removing a packaging tie-down of the present disclosure from a retention strap.

The tie-down is typically readily removed, thereby lending itself to a method 140 of removing a packaging tie-down, as shown in FIG. 23. The method may include removing the retention strap from the engaging structure of the packaging tie-down at 142, unfolding the retention strap at 144, and removing the packaging tie-down from the retention strap at 146.

Figure 24:
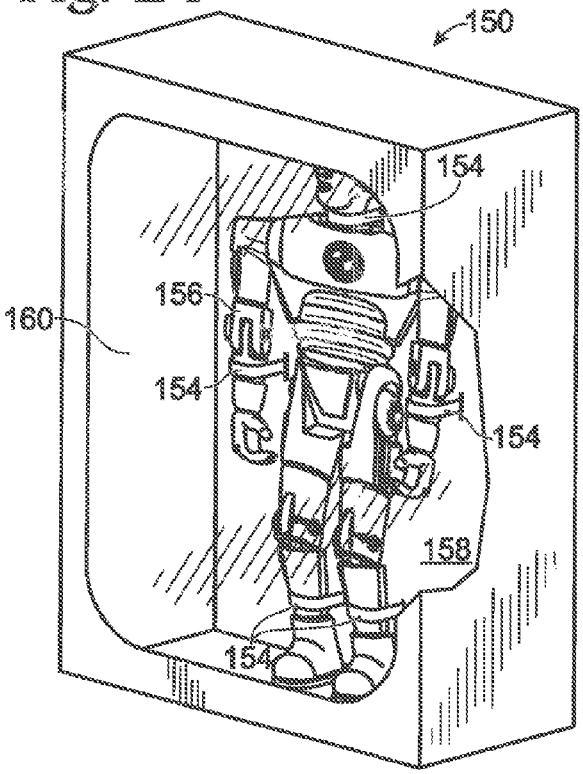
FIG. 24 is an isometric cutaway view of a packaged toy figure secured by exemplary packaging tie-downs and retention straps according to the present disclosure.
Figure 25:
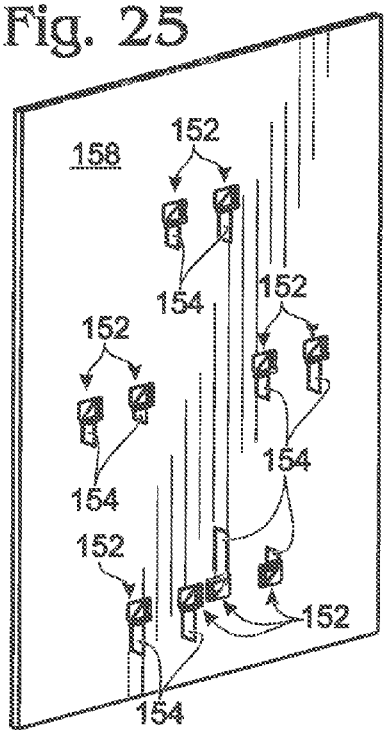
FIG. 25 is an isometric view of the rear of the backing sheet of the packaged toy figure of FIG. 24.

The presently disclosed tie-downs are useful for securing a variety of objects and items, including oddly-shaped, or cumbersome objects. In particular, the disclosed tie-downs are particularly well-suited to the packaging of toys, such as packaged toy 150 of FIGS. 24 and 25. In the case of packaged toy 150, a plurality of packaging tie-downs 152 secure the ends of retention straps 154 that in turn secure a toy 156 against a backing sheet 158. Where the retention strap is transparent, the toy may be firmly secured against the backing sheet without the straps presenting a visual distraction. This is particularly true where the toy is displayed under a transparent blister or beneath a transparent window 160, as shown in FIG. 24. In addition, the disclosed tie-downs are readily and easily removed, permitting even small children to unpack packaged toys themselves, allowing more immediate gratification, for example, during birthday parties or other holidays. The disclosed tie-downs may be used in conjunction with any of a variety of toys, including action figures, figurines, dolls, and other characters.

Although the present invention has been shown and described with reference to the foregoing operational principles and preferred embodiments, it will be apparent to those skilled in the art that various changes in form and detail can be made without departing from the spirit and scope of the invention as defined in the following claims. The present invention is intended to embrace all such alternatives, modifications and variances, including all novel and non-obvious combinations and subcombinations of the various elements, features, functions and/or properties disclosed herein.

What is claimed is:

1. A packaged item, comprising packaging material;

a retention strap securing an item to the packaging material; and a substantially planar tie-down body, the body comprising:

an aperture in the tie-down body configured to receive the retention strap; and an engaging structure on the tie-down body including a tongue defining an open slot, the tongue having a tab projecting into the open slot and a corresponding indentation in the other side of the slot, where the engaging structure is configured to securely engage the retention strap and includes a groove on the underside of the engaging structure configured to provide a channel for the retention strap.

2. The packaged item of claim 1, where the engaging structure is configured to securely and reversibly engage the retention strap.

3. The packaged item of claim 1, where the aperture is a slit, and the aperture and the open slot are disposed at approximately 90 degrees.

4. The packaged item of claim 1, where the tie-down body is configured so that the retention strap is securable by threading it upwardly through the aperture, folding it upon itself, and passing it through the open slot and under the tongue.

5. The packaged item of claim 1, further comprising one or more protrusions on an underside of the tie-down body.

6. The packaged item of claim 1, further comprising a retention plate, wherein the retention strap is affixed to the retention plate.

7. A packaged item, comprising:

packaging material;

a retention strap securing an item to the packaging material; and a substantially planar tie-down body, the body comprising:

a slit in the tie-down body configured to receive the retention strap; and a tongue that is at least partially elevated with respect to the tie-down body, the tongue defining an open slot on the tie-down body, where the open slot is disposed at substantially a right angle to the slit in the tie-down body, and where the open slot is configured to securely engage the retention strap;

wherein the open slot includes a tab projecting from one side of the slot, and a corresponding indentation in the other side of the slot.

8. The packaged item of claim 7, where the tongue includes a groove on the underside of the tongue configured to provide a channel for the retention strap.

9. The packaged item of claim 7, where the tongue is configured to securely and reversibly engage the retention strap.

10. The packaged item of claim 7, where the tie-down body is configured so that the retention strap is securable by threading it upwardly through the slit, folding it upon itself, and passing it through the open slot and under the tongue.

11. The packaged item of claim 7, further comprising one or more protrusions on an underside of the tie-down body.

12. The packaged item of claim 11, where the tongue includes a groove on the underside of the tongue configured to provide a channel for the retention strap.

13. The packaged item of claim 7, further comprising a retention plate, wherein the retention strap is affixed to the retention plate.

14. A packaged item, comprising:

packaging material;

a retention strap securing an item to the packaging material; and a packaging tie-down, the tie-down comprising:

means for receiving the retention strap in a tie-down body; and means for engaging the retention strap;

wherein the means for engaging the retention strap is at least partially elevated with respect to the tie-down body and includes a groove on the underside of the means for engaging the retention strap, the groove configured to provide a channel to receive the retention strap;

further wherein the means for engaging the retention strap defines an open slot, the open slot including a tab projecting from one side of the slot, and a corresponding indentation in the other side of the slot.

15. The packaged item of claim 14, where the tie-down is configured to be secured against a backing sheet when the retention strap is engaged.

16. The packaged item of claim 14, where the means for engaging the retention strap is configured to securely and reversibly engage the retention strap.

17. The packaged item of claim 14, where the means for engaging the retention strap includes a tongue defining the open slot.

18. The packaged item of claim 14, where the means for receiving the retention strap and the open slot are disposed at approximately 90 degrees.

19. The packaged item of claim 14, where the tie-down is configured so that the retention strap is securable by threading it upwardly through the means for receiving the retention strap, folding it upon itself, and passing it through the open slot and under the means for engaging the retention strap.

20. The packaged item of claim 14, further comprising one or more protrusions on an underside of the tie-down body.

* * * * *